US009080449B2

(12) United States Patent
Bridges et al.

(10) Patent No.: US 9,080,449 B2
(45) Date of Patent: Jul. 14, 2015

(54) GAS TURBINE ENGINE SEAL ASSEMBLY HAVING FLOW-THROUGH TUBE

(75) Inventors: Joseph W. Bridges, Durham, CT (US); David F. Cloud, Simsbury, CT (US); David P. Houston, Glastonbury, CT (US); Eric W. Malmborg, Amston, CT (US)

(73) Assignee: United Technologies Corporation, Hartford, CT (US)

( * ) Notice: Subject to any disclaimer, the term of this patent is extended or adjusted under 35 U.S.C. 154(b) by 638 days.

(21) Appl. No.: 13/210,609

(22) Filed: Aug. 16, 2011

(65) Prior Publication Data

US 2013/0045089 A1 Feb. 21, 2013

(51) Int. Cl.
*F01D 11/00* (2006.01)
*F01D 5/08* (2006.01)

(52) U.S. Cl.
CPC ..... *F01D 5/082* (2013.01); *F01D 11/005* (2013.01)

(58) Field of Classification Search
CPC ..... F01D 11/00–11/0008; F01D 5/08; F01D 5/081; F01D 5/082; F01D 25/12
USPC ..... 415/1, 115
See application file for complete search history.

(56) References Cited

U.S. PATENT DOCUMENTS

| | | | | |
|---|---|---|---|---|
| 3,742,705 | A * | 7/1973 | Sifford | 60/806 |
| 4,178,129 | A * | 12/1979 | Jenkinson | 416/95 |
| 4,375,891 | A * | 3/1983 | Pask | 415/115 |
| 4,456,427 | A * | 6/1984 | Evans et al. | 416/95 |
| 4,666,368 | A | 5/1987 | Hook, Jr. et al. | |
| 4,708,588 | A * | 11/1987 | Schwarz et al. | 415/115 |
| 4,813,848 | A * | 3/1989 | Novotny | 416/95 |
| 4,910,958 | A * | 3/1990 | Kreitmeier | 60/806 |
| 5,593,274 | A | 1/1997 | Carreno et al. | |
| 5,833,244 | A * | 11/1998 | Salt et al. | 277/421 |
| 6,183,193 | B1 | 2/2001 | Glasspoole et al. | |
| 6,397,604 | B2 | 6/2002 | Eldrid et al. | |
| 6,776,573 | B2 * | 8/2004 | Arilla et al. | 415/115 |
| 7,137,777 | B2 * | 11/2006 | Fried et al. | 415/115 |
| 7,147,431 | B2 * | 12/2006 | Maguire et al. | 415/115 |
| 7,341,429 | B2 | 3/2008 | Montgomery et al. | |
| 7,870,742 | B2 | 1/2011 | Lee et al. | |
| 8,186,938 | B2 * | 5/2012 | Young et al. | 415/115 |
| 8,240,975 | B1 * | 8/2012 | Ryznic | 415/1 |
| 2009/0175732 | A1 | 7/2009 | Glasspoole et al. | |

* cited by examiner

*Primary Examiner* — Nathaniel Wiehe
*Assistant Examiner* — Brian O Peters
(74) *Attorney, Agent, or Firm* — Carlson, Gaskey & Olds

(57) ABSTRACT

A seal assembly for a gas turbine engine includes an annular body and a flow-through tube that extends through the annular body. The flow-through tube includes an upstream orifice, a downstream orifice and a tube body that extends between the upstream orifice and the downstream orifice. The tube body establishes a gradually increasing cross-sectional area between the downstream orifice and the upstream orifice.

21 Claims, 5 Drawing Sheets

GAS TURBINE ENGINE SEAL ASSEMBLY HAVING FLOW-THROUGH TUBE

BACKGROUND

This disclosure relates to a gas turbine engine, and more particularly to a seal assembly having a flow-through tube that communicates conditioned airflow aboard an adjacent rotor assembly.

Gas turbine engines typically include at least a compressor section, a combustor section and a turbine section. During operation, air is pressurized in the compressor section and mixed with fuel and burned in the combustor section to generate hot combustion gases. The hot combustion gases are communicated through the turbine section which extracts energy from the hot combustion gases to power the compressor section and other gas turbine engine loads.

Gas turbine engines channel airflow through the core engine components along a primary gas path. Portions of the gas turbine engine must be conditioned (i.e., heated or cooled) to ensure reliable performance and durability. For example, the rotor assemblies of the compressor section and the turbine section of the gas turbine engine may require conditioning airflow.

SUMMARY

A seal assembly for a gas turbine engine includes an annular body and a flow-through tube extending through the annular body. The flow-through injector tube includes an upstream orifice, a downstream orifice and a tube body that extends between the upstream orifice and the downstream orifice. The tube body establishes a gradually increasing cross-sectional area between the downstream orifice and the upstream orifice.

In another exemplary embodiment, the gas turbine engine includes a first rotor assembly, a second rotor assembly downstream from the first rotor assembly, and a vane assembly positioned between the first rotor assembly and the second rotor assembly. A seal assembly is positioned adjacent to a radially inner side of the vane assembly. The seal assembly includes a plurality of flow-through tubes that receive a conditioning airflow. The conditioning airflow is communicated in an upstream direction through the second rotor assembly and the plurality of flow-through tubes of the seal assembly to a position onboard of the first rotor assembly.

In yet another exemplary embodiment, a method for communicating conditioning airflow through a gas turbine engine includes communicating the conditioning airflow in a direction that is opposite of a core airflow communicated along a primary gas path of a gas turbine engine.

The various features and advantages of this disclosure will become apparent to those skilled in the art from the following detailed description. The drawings that accompany the detailed description can be briefly described as follows.

DETAILED DESCRIPTION

Figure 1:
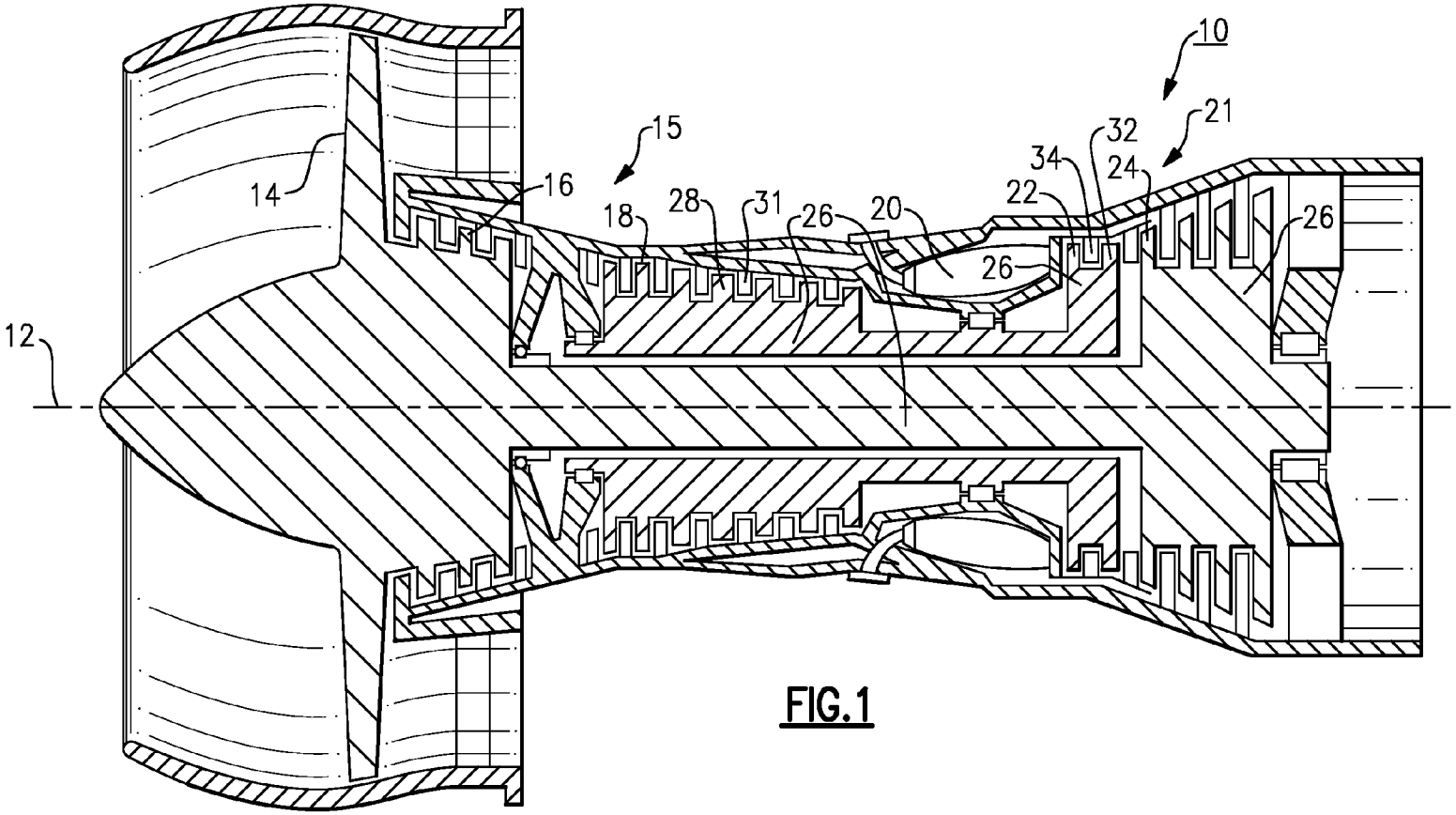
FIG. 1 illustrates a cross-sectional view of a gas turbine engine.

FIG. 1 illustrates a gas turbine engine 10, such as a turbofan gas turbine engine, that is circumferentially disposed about an engine centerline axis (or axially centerline axis) 12. The gas turbine engine 10 includes a fan section 14, a compressor section 15 having a low pressure compressor 16 and a high pressure compressor 18, a combustor section 20 and a turbine section 21 including a high pressure turbine 22 and a low pressure turbine 24. This disclosure can also extend to engines without a fan, and with more or fewer sections.

As is known, air is compressed in the low pressure compressor 16 and the high pressure compressor 18, is mixed with fuel and is burned in the combustor section 20, and is expanded in the high pressure turbine 22 and the low pressure turbine 24. Rotor assemblies 26 rotate in response to the expansion, driving the low pressure and high pressure compressors 16, 18 and the fan section 14. The low and high pressure compressors 16, 18 include alternating rows of rotating rotor airfoils or blades 28 and static stator vanes 31. The high and low pressure turbines 22, 24 also include alternating rows of rotating rotor airfoils or blades 32 and static stator vanes 34.

This view is highly schematic and is included to provide a basic understanding of the gas turbine engine 10 and not to limit the disclosure. This disclosure extends to all types of gas turbine engines and for all types of applications.

Figure 2:
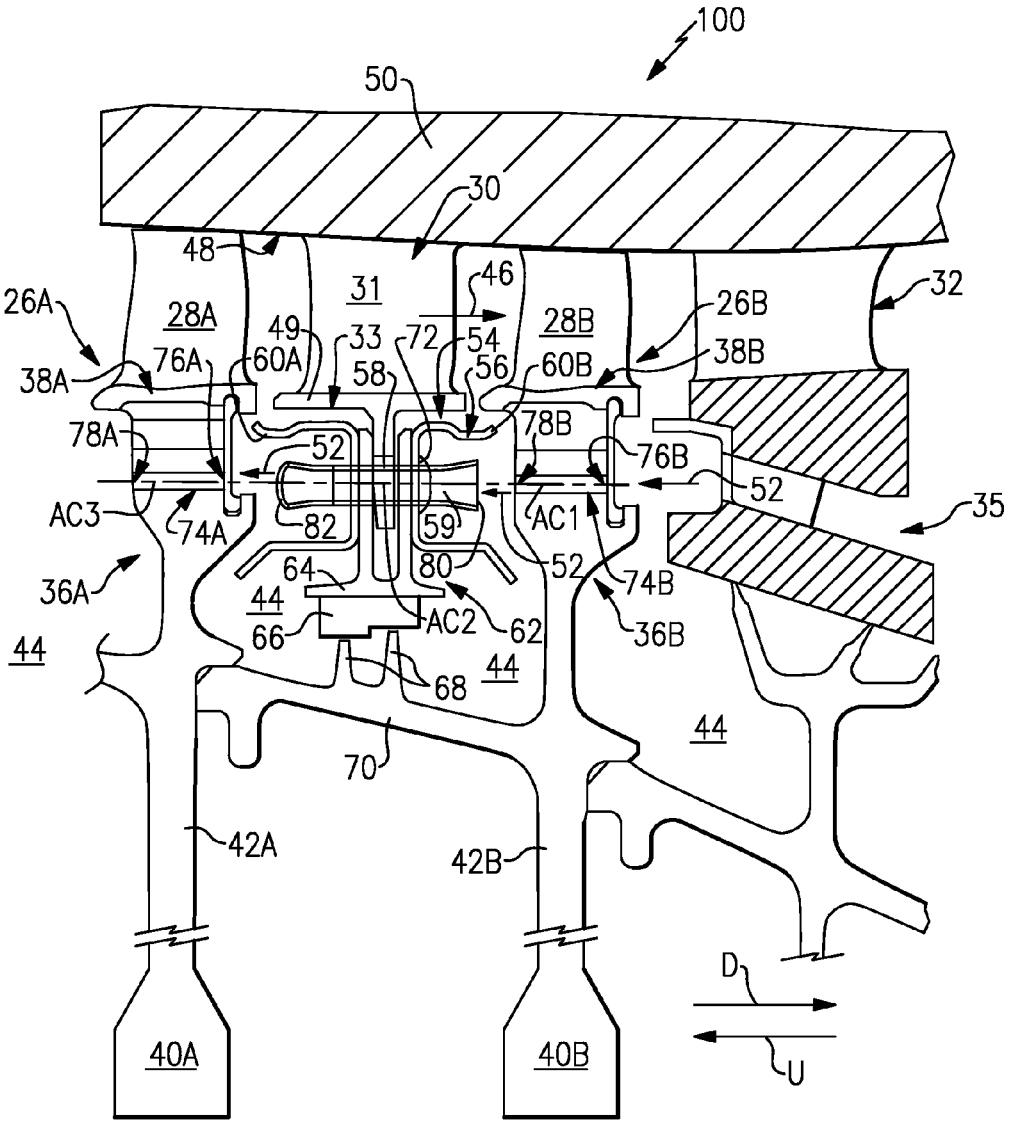
FIG. 2 illustrates a cross-sectional view of a portion of a gas turbine engine.

FIG. 2 illustrates a portion 100 of the gas turbine engine 10. In this example, the portion 100 depicted in FIG. 2 is the high pressure compressor 18 of the gas turbine engine 10. This disclosure is not limited to the high pressure compressor 18, and the various features identified herein could extend to other sections of the gas turbine engine 10.

In this example, the portion 100 includes a first rotor assembly 26A and a second rotor assembly 26B that is positioned axially downstream from the first rotor assembly 26A. A vane assembly 30 having at least one stator vane 31 is positioned axially between the first rotor assembly 26A and the second rotor assembly 26B. Although two rotor assemblies and a single vane assembly are illustrated, it should be understood that the gas turbine engine 10 could include fewer or additional rotor and vane assemblies.

An exit guide vane 32 is positioned downstream from the second rotor assembly 26B. A nozzle assembly 35 can be positioned radially inward from the exit guide vane 32. The nozzle assembly 35 can include a tangential onboard injection (TOBI) nozzle or other suitable nozzle that is capable of communicating a conditioning airflow. The example nozzle assembly 35 communicates a conditioning airflow to the first rotor assembly 26A, the second rotor assembly 26B and the vane assembly 30, as is further discussed below. In this disclosure, the term "conditioning airflow" is defined to include both cooling and heating airflows.

The rotor assemblies 26A, 26B includes rotor airfoils 28A, 28B and rotor disks 36A, 36B, respectively. The rotor disks 36A, 36B include rims 38A, 38B, bores 40A, 40B, and webs 42A, 42B that extend between the rims 38A, 38B and the bores 40A, 40B. A plurality of cavities 44 extend between adjacent rotor disks 36A, 36B. The cavities 44 are radially inward from the airfoils 28A, 28B and the vane assembly 30.

A primary gas path 46 for directing the stream of core airflow axially in an annular flow is generally defined by the rotor assemblies 26A, 26B and the vane assembly 30. More particularly, the primary gas path 46 extends radially between an inner wall 48 of an engine casing 50 and the rims 38A, 38B of the rotor disks 36A, 36B, as well as an inner platform 49 of the vane assembly 30.

A secondary gas path 52 is defined by the first rotor assembly 26A, the second rotor assembly 26B and the vane assembly 30 radially inward relative to the primary gas path 46. The secondary gas path 52 communicates a conditioning airflow through the various cavities 44 to condition specific areas of the rotor assemblies 26A, 26B, such as the rims 38A, 38B. The secondary gas path 52 is communicated in a direction that is opposite of the core airflow of the primary gas path 46. Put another way, the core airflow of the primary gas path 46 is communicated in a downstream direction D and the conditioning airflow of the secondary gas path 52 is communicated in an opposing upstream direction U.

A seal assembly 54 is positioned on a radially inner side 33 of the vane assembly 30. For example, the seal assembly 54 could include an inner vane sealing mechanism for sealing the cavities 44. Although only a single seal assembly is illustrated, the portion 100 could incorporate multiple seal assemblies positioned relative to additional vane assemblies of the gas turbine engine.

The seal assembly 54 includes an annular body 56 and a flow-through tube 58 that extends through the annular body 56. The flow-through tube defines a passage 59 for directing the conditioning airflow through the seal assembly 54. The seal assembly 54 can include a plurality of flow-through tubes 58 that are circumferentially spaced about the annular body 56.

The annular body 56 can include a first channel seal 60A and a second channel seal 60B. The flow through tube 58 is disposed through the channel seals 60A, 60B. The channel seals 60A, 60B are generally U-shaped (in the axial direction). The channel seals 60A, 60B trap airflow within the annular body 56 and communicate the conditioning airflow through the flow-through tubes 58 once it is gathered by the channel seals 60A, 60B.

The seal assembly 54 further includes a seal system 62, such as a knife-edge seal system, that seals the cavities 44. The seal system 62 extends radially inward from the annular body 56 and includes a seal flange 64 having a seal 66, such as a honeycomb seal. Knife edges 68 protrude from portions 70 of the rotor disks 36A, 36B. The knife edges 68 cut into the seal 66 as known to seal the cavities 44. A fastener 72 connects the annular body 56 (including channel seals 60A, 60B), the flow-through tubes 58 and the seal system 62 of the seal assembly 54.

The first rotor assembly 26A and the second rotor assembly 26B include slots 74A, 74B (a first slot 74A and a second slot 74B) that extend through the rotor disk 36A, 36B, respectively. The slots 74A, 74B extend through the rims 38A, 38B. The slots 74A, 74B include inlets 76A, 76B and outlets 78A, 78B.

The inlet 76B of the slot 74B is aligned with the nozzle assembly 35. The outlet 78B of the slot 74B is aligned with an inlet 80 of the flow-through tube 58. In addition, an outlet 82 of the flow-through tube 58 is aligned with an inlet 76A of the slot 74A. In other words, an axial centerline axis AC1 of the slot 74B is aligned with the nozzle assembly 35 and an axial centerline axis AC2 of the flow-through tube, and the axial centerline axis AC2 is also aligned with an axial centerline axis AC3 of the slot 74A. The axial centerline axes AC1, AC2 and AC3 could also be slightly radially offset relative to one another and still fall within the scope of this disclosure.

The flow-through tube(s) 58 provides the path of least resistance for the conditioning airflow. Because of the generally aligned centerline axes AC1, AC2 and AC3, the conditioning airflow can be communicated in an upstream direction through slot 74B, and then through the flow-through tube 58, to a position onboard of the first rotor assembly 26A (i.e., the conditioning airflow can condition the rotor assembly 26A at a position that is radially inward from the airfoil 28A).

Figure 3:
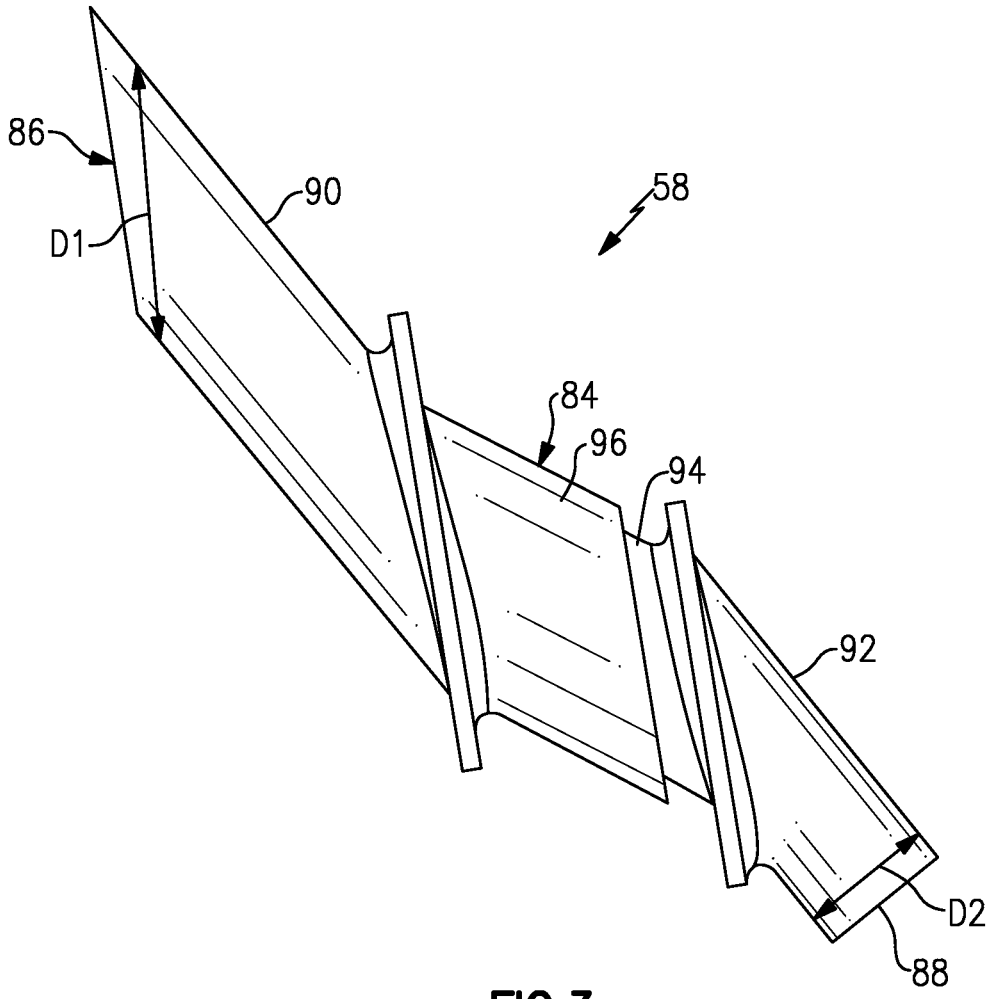
FIG. 3 illustrates a portion of a seal assembly that can be incorporated into a gas turbine engine.

FIG. 3 illustrates an example flow-through tube 58 of the seal assembly 54. The flow-through tube 58 can be a cast or machined feature of the seal assembly 54, or can be a separate structure that must be mechanically attached to the seal assembly 54. The flow-through tube 58 can also embody a single-piece design or a multiple-piece design.

The flow-through tube 58 defines a tube body 84 that extends between an upstream orifice 86 and a downstream orifice 88. The upstream orifice 86 defines the outlet 82 of the flow-through tube 58 and the downstream orifice 88 defines the inlet 80. The upstream orifice 86 aligns with the inlet 76A of the slot 74A and the downstream orifice 88 aligns with the outlet 78B of the slot 74B (see FIG. 2).

The tube body 84 establishes a gradually increasing cross-sectional area between the downstream orifice 88 and the upstream orifice 86 (i.e., in a direction from the downstream orifice 88 toward the upstream orifice 86). In other words, the cross-sectional area of the tube body 84 decreases between the upstream orifice 86 and the downstream orifice 88. The upstream orifice 86 defines a diameter D1 that is a greater diameter than a diameter D2 of the downstream orifice 88.

The tube body 84 can include a first tube body section 90 and a second tube body section 92 where a two-piece design is embodied. The second tube body section 92 is received within the first tube body section 90. An upstream portion 94 of the second tube body section 92 is received within a downstream portion 96 of the first tube body section 90 to connect the second tube body section 92 to the first tube body section 90. The increasing cross-sectional area of the tube body 84 is established by the connection of the first tube body section 90 and the second tube body section 92.

Figure 4:
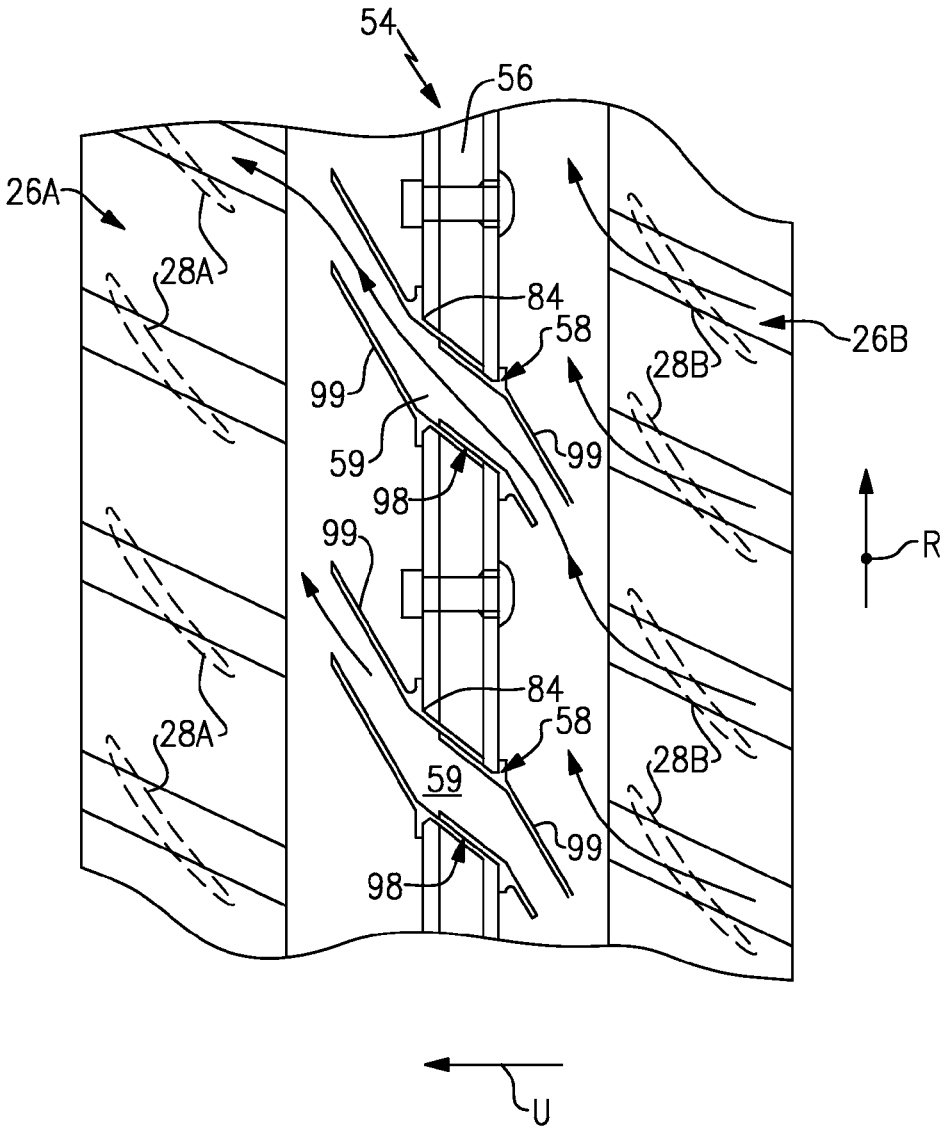
FIG. 4 illustrates additional features of the seal assembly of FIG. 3.

FIG. 4 illustrates an axial top view of the seal assembly 54. The seal assembly 54 extends axially between the first rotor assembly 26A and the second rotor assembly 26B. The first rotor assembly 26A and the second rotor assembly 26B rotate in a direction of arrow R during engine operation. The flow-through tubes 58 establish the passage 59 for communicating the conditioning airflow from the second rotor assembly 26B toward the first rotor assembly 26A.

The tube bodies 84 of the flow-through tubes 58 include a generally axial portion 98 and generally tangential portions 99 that enable communication of the conditioning airflow, which includes axial and tangential components because the first rotor assembly 26A and the second rotor assembly 26B rotate, in an upstream direction U onboard of the first rotor assembly 26A. The generally tangential portions 99 of the tube body 84 are transverse to the generally axial portion 98.

Figure 5:
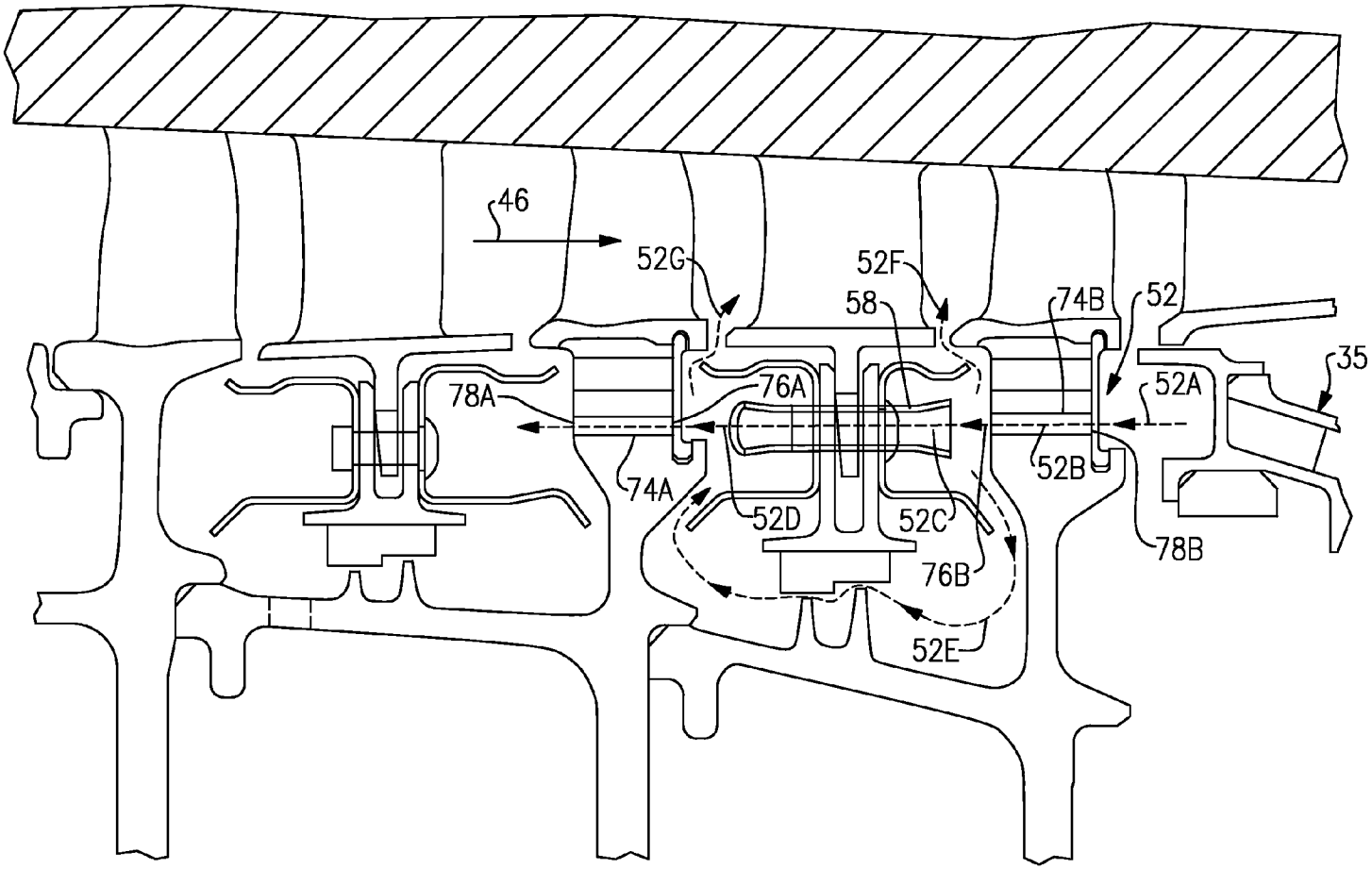
FIG. 5 illustrates a secondary gas path of a gas turbine engine.

FIG. 5 schematically illustrates the secondary gas path 52 of the conditioning airflow. The secondary gas path of the conditioning airflow is generally in the direction U. The direction U is an upstream direction that is opposite from the downstream direction of core flow of the primary gas path 46.

The conditioning airflow is first communicated along path 52A from the nozzle assembly 35 into the outlet 78B of the slot 74B. The conditioning airflow is communicated through the slot 74B along a path 52B. Next, the conditioning airflow is communicated into the flow-through tube(s) 58 along a path 52C. Portions of the conditioning airflow may escape the secondary gas path 52 and are illustrated as leakage paths 52E and 52F.

The conditioning airflow that is communicated through the flow-through tube(s) 58 exits the flow-through tube(s) 58 along a path 52D and enters an outlet 78A of the slot 74A. The conditioning airflow communicated along the path 52D is communicated onboard the rotor disk 36A of the first rotor assembly 26A to condition the rim 38A and any other portion that may required conditioned airflow. Additional portions of the conditioning airflow may escape the secondary gas path 52 along leakage paths 52F and 52G.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A seal assembly for a gas turbine engine, comprising:

an annular body that includes a first flange and a second flange spaced from said first flange, said first flange and said second flange both including an upstream face and a downstream face;

a flow-through tube extending through said upstream face and said downstream face of each of said first flange and said second flange of said annular body and including an upstream orifice, a downstream orifice and a tube body that extends between said upstream orifice and said downstream orifice, said tube body including an axial portion and a tangential portion, wherein said axial portion and said tangential portion together communicate a conditioning airflow in an upstream direction from said downstream orifice toward said upstream orifice of said flow-through tube.

2. The assembly as recited in claim 1, wherein said seal assembly is an inner vane seal assembly of a compressor section of the gas turbine engine.

3. The assembly as recited in claim 1, comprising a seal system that extends radially inwardly from said annular body.

4. The assembly as recited in claim 1, comprising a plurality of flow-through tubes circumferentially disposed about said annular body.

5. The assembly as recited in claim 1, wherein said annular body includes a first channel seal and a second channel seal.

6. The assembly as recited in claim 5, wherein said flow-through tube is disposed between said first channel seal and said second channel seal.

7. The assembly as recited in claim 1, wherein said tube body includes a first tube body section and a second tube body section received within said first tube body section.

8. The assembly as recited in claim 1, wherein said tube body establishes a gradually increasing cross-sectional area between said downstream orifice and said upstream orifice.

9. The assembly as recited in claim 8, wherein said gradually increasing cross-sectional area increases in a direction from said downstream orifice toward said upstream orifice.

10. The assembly as recited in claim 1, wherein a portion of a vane assembly extends between said first flange and said second flange.

11. The assembly as recited in claim 1, comprising a first channel seal mounted to said first flange and a second channel seal mounted to said second flange.

12. A gas turbine engine, comprising:

a first rotor assembly;

a second rotor assembly downstream from said first rotor assembly;

a vane assembly positioned between said first rotor assembly and said second rotor assembly;

a seal assembly on a radially inner side of said vane assembly, and said seal assembly includes a plurality of flow-through tubes that receive a conditioning airflow; and wherein said conditioning airflow is communicated in an upstream direction through said second rotor assembly and said plurality of flow-through tubes of said seal assembly to condition said first rotor assembly.

13. The gas turbine engine as recited in claim 12, wherein said first rotor assembly, said second rotor assembly and said vane assembly define a primary gas path and a secondary gas path radially inward from said primary gas path.

14. The gas turbine engine as recited in claim 13, wherein a core airflow of said primary gas path is communicated in a first direction and said conditioning airflow of said secondary gas path is communicated in a second direction that is opposite from said first direction.

15. The gas turbine engine as recited in claim 12, wherein said first rotor assembly includes a first slot and said second rotor assembly includes a second slot, wherein an axial centerline axis of said plurality of flow-through tubes is aligned with an axial centerline axis of each of said first slot and said second slot.

16. The gas turbine engine as recited in claim 12, comprising a nozzle assembly downstream from said second rotor assembly, wherein said conditioning airflow is communicated from said nozzle assembly to said second rotor assembly.

17. A method for communicating conditioning airflow through a gas turbine engine, comprising the steps of:

communicating the conditioning airflow in a direction that is opposite of a core airflow of a primary gas path of the gas turbine engine, including communicating the conditioning airflow in an upstream direction through a first rotor assembly and then through a seal assembly prior to conditioning a second rotor assembly, wherein the seal assembly includes an annular body including a first flange, a second flange spaced from the first flange, and a flow-through tube that extends through an upstream face and a downstream face of both of the first flange and the second flange.

18. The method as recited in claim 17, wherein the step of communicating the conditioning airflow includes the step of:

communicating the conditioning airflow through a slot of the first rotor assembly and then through the seal assembly and then through a slot of the second rotor assembly.

19. The method as recited in claim 18, wherein the conditioning airflow is communicated through the flow-through tube of the seal assembly.

20. The method as recited in claim 17, wherein the conditioning airflow includes an axial component and a tangential component.

21. The method as recited in claim 17, wherein the conditioning airflow is communicated from a nozzle assembly to the first rotor assembly.

* * * * *